US009915087B2

(12) United States Patent
Kreyenborg et al.

(10) Patent No.: US 9,915,087 B2
(45) Date of Patent: Mar. 13, 2018

(54) ROLLER CARRIAGE FOR THE RECEPTION OF A SLIDING DOOR WITH A HEIGHT ADJUSTING DEVICE

(71) Applicant: DORMA Deutschland GmbH, Ennepetal (DE)

(72) Inventors: Ralf Kreyenborg, Ennepetal (DE); Sven Busch, Ennepetal (DE); Jan-Hendrik Jahnke, Ennepetal (DE); Arne Liebscher, Ennepetal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 0 days.

(21) Appl. No.: 14/938,789

(22) Filed: Nov. 11, 2015

(65) Prior Publication Data

US 2016/0138312 A1 May 19, 2016

(30) Foreign Application Priority Data

Nov. 14, 2014 (EP) ..... 14193361

(51) Int. Cl.

| | |
|---|---|
| ***E05D 13/00*** | (2006.01) |
| ***E05D 15/06*** | (2006.01) |
| ***E06B 3/46*** | (2006.01) |

(52) U.S. Cl.

CPC ..... *E05D 15/0634* (2013.01); *E05D 15/0643* (2013.01); *E05D 15/0656* (2013.01); *E05D 15/0669* (2013.01); *E05D 15/0682* (2013.01); *E05D 15/0686* (2013.01); *E05D 15/0691* (2013.01); *E06B 3/4636* (2013.01); *E05Y 2201/64* (2013.01); *E05Y 2600/12* (2013.01); *E05Y 2900/132* (2013.01)

(58) Field of Classification Search

CPC ..... E05D 15/0634; E05D 15/0656; E05D 15/0691; E05D 15/0669; E05D 15/0643; E05D 15/0682; E05D 15/0686; E05D 3/4636

USPC ..... 49/425, 409

See application file for complete search history.

(56) References Cited

U.S. PATENT DOCUMENTS

| | | | | |
|---|---|---|---|---|
| 6,698,138 | B1 * | 3/2004 | Lin | 49/409 |
| 9,038,316 | B2 * | 5/2015 | Von Gerichten | 49/360 |
| 2011/0005140 | A1 * | 1/2011 | Guidos et al. | 49/425 |
| 2013/0111702 | A1 * | 5/2013 | Ewing | 16/91 |

(Continued)

FOREIGN PATENT DOCUMENTS

| | | | |
|---|---|---|---|
| EP | 2886763 | A1 * | 6/2015 |
| WO | WO 2014/060931 | A1 * | 4/2014 |

(Continued)

*Primary Examiner* — Jerry E Redman

(74) *Attorney, Agent, or Firm* — Cantor Colburn LLP

(57) ABSTRACT

A roller carriage for the reception of a sliding door includes a roller module for the displaceable affixing at a roller running path and a basic body for the attachment to the sliding door. The basic body is supported at the roller module to be displaceable along a direction of gravity (SKR) for a fine-tuning movement, wherein a first adjusting component for an adjusting movement is supported at the basic body to be movable. For a movement of the basic body along a direction of gravity in relation to the roller module when performing the adjusting movement, the first adjusting component is in operative connection with a second adjusting component of the roller module.

13 Claims, 7 Drawing Sheets

(56) References Cited

U.S. PATENT DOCUMENTS

| | | | | |
|---|---|---|---|---|
| 2014/0310913 | A1* | 10/2014 | Horwood | 16/100 |
| 2015/0026928 | A1* | 1/2015 | Haab et al. | 16/96 R |
| 2015/0074942 | A1* | 3/2015 | Haab et al. | 16/102 |
| 2015/0211275 | A1* | 7/2015 | Terno | |

FOREIGN PATENT DOCUMENTS

| | | | |
|---|---|---|---|
| WO | WO 2014/121355 | A1 * | 8/2014 |
| WO | 2015017878 | A1 | 2/2015 |

* cited by examiner

ROLLER CARRIAGE FOR THE RECEPTION OF A SLIDING DOOR WITH A HEIGHT ADJUSTING DEVICE

FIELD

The present disclosure relates to a roller carriage for the reception of a sliding door including a height adjusting device, a sliding door installation with such a roller carriage, as well as to a method for fine-tuning the height of such a sliding door installation.

BACKGROUND

For conventional sliding doors, sliding door installations are used, which are equipped with a roller running path. Said roller running path is usually affixed to the ceiling or the wall above the door opening. One or more roller carriages, which is/are able to perform a linear motion in a rolling or sliding manner on the roller running path, are placed on the roller running path, respectively in the roller running path. Sliding doors in the shape of sliding door bodies are affixed respectively attached to the roller carriages. Such sliding doors may be manufactured from many various materials. For example lumber sliding doors or glass sliding doors may be employed. Depending on the employed material and the type of the site, in this case, many different weight classes are possible for the sliding doors. In particular with glass sliding doors also high weights of up to 150 kg and more per each sliding door are conceivable.

In conventional roller carriages and sliding door installations, it is disadvantageous that the exact adjustment of the vertical positioning of the sliding door required a lot of effort. Thus, for acoustic sealing and thermal isolation, it is necessary to set a well-defined and possibly small gap at the underside between a floor and the sliding door itself. A fine-tuning of the height of the sliding door at the roller module, respectively in the roller carriage is necessary for this purpose. Usually, this procedure is realized by opening the associated clamps at the sliding door and by a corresponding displacement of the sliding door. This procedure required high effort, because either two people are necessary for the displacement with the roller carriage being suspended, or otherwise the roller carriage needs to be removed from the roller running path each time, in order to be able to subsequently perform the fine-tuning step in the upright or recumbent condition. In addition to inaccuracies during the adjustment of the described gap, this results in increased mounting expense and considerably longer mounting times.

Therefore, the present disclosure overcomes the above-described disadvantages. Specifically, the present disclosure provides a roller carriage for performing the most precise possible fine-tuning with regard to the height adjustment of the sliding door in an inexpensive and simple manner.

SUMMARY

Features and details, described in conjunction with the inventive roller carriage, are obviously also valid in conjunction with the inventive sliding door installation as well as with the inventive method, and respectively vice versa, such that mutual reference is made, respectively can be made with respect to the disclosure of individual aspects of the invention.

An inventive roller carriage serves for accommodating a sliding door. The roller carriage includes a roller module for a displaceable affixing at a roller running path. Furthermore, a basic body is provided for the attachment to the sliding door. An inventive roller carriage is distinguished in that the basic body is supported at the roller module to be movable along a direction of gravity for the fine-tuning movement. In this case, a first adjusting means is supported at the basic body to be movable for an adjusting movement. The first adjusting means is in an operative connection with a second adjusting means for a movement of the basic body along the direction of gravity in relation to the roller module, when performing the adjusting movement.

An inventive roller carriage includes in particular at least two structural components, namely the roller module and the basic body. In this case, obviously further structural components may be provided and/or said two structural components may be composed of individual bodies. A roller carriage according to the idea of the present disclosure is an overall system, which fulfills at least two functions. On the one hand, the roller module allows for the displaceable affixing on the roller running path. Even if, already in this stage, the terminology of roller is utilized, an affixing of bearing devices for rollers represents only one optional embodiment of an inventive roller carriage. Obviously, for the displaceable bearing, such a roller carriage may likewise include a linear guidance, for example an anti-friction bearing or a linear drive. However, with regard to reduced complexity and reduced cost, the embodiment with rotatable rollers is preferred for such a bearing device. As the second function, the attachment of the sliding door is provided.

In this case, the attachment may be a clamped attachment.

According to the disclosure, the roller module and the basic body are separate structural components, respectively separate bodies. Each one of said two structural components, namely the roller module and/or the basic body, may in turn include a plurality of individual components, which are connected among each other.

Thus, the roller module may include for example corresponding bearing devices in the shape of rotatably supported rollers. The basic body may include a plurality of individual structural components, such as for example further devices for the additional functions. In addition to a height adjusting device, they may as well include a securing device, a fixing device or else a clamping device, by means of which the sliding door can be attached to the basic body.

Basically and according to the disclosure, the direction of movement by means of the roller carriage is freely selectable. Thus, in this case within the scope of the present disclosure, a movement along a straight can be performed, such as a movement along a line of movement, which is curved or curved several times, is conceivable.

In this case, a displaceable affixing at a roller running path is to be understood for the respective embodiment of the bearing. In case bearing devices in the shape of individual rollers are provided, said rollers are inserted into a corresponding roller running path. If for example an anti-friction bearing is provided, affixing the roller module is realized on a corresponding sliding rail, respectively at a corresponding sliding rail.

Preferably, the roller module is manufactured from steel casting material. The basic body may be lighter and manufactured for example from light metal diecast. As light metal diecast, in particular aluminum or zinc are utilized.

According to the disclosure, now a height adjusting device may be provided. Said height adjusting device serves the purpose, in the inserted condition or as an alternative likewise in the recumbent condition, of performing a relative positioning between the roller carriage and the basic body. By affixing the sliding door at the basic body, the position of the basic body corresponds to the position of the sliding body, and simultaneously by placing into, respectively onto or to a roller running path, the associated roller module corresponds to the position of the roller running path and thereby to the absolute position of the door opening, so that a relative positioning between the basic body and the roller module provide a fine tuning of the height in the relative positioning between the sliding door and the door opening.

According to the disclosure, the height adjusting device is equipped with two adjusting means corresponding to each other. A first adjusting means is supported to be movable in the basic body so that an adjusting movement can be performed. Said adjusting movement may be a single movement or a combination of different movements. In this context rotary motions are as conceivable as translatory, in particular linear motions. Also motions combined of different motion components, which can be provided by means of guiding means, are conceivable for performing the adjusting movement within the scope of the present disclosure.

The second adjusting means correlates with the roller module and may be in particular configured to be static. In this case, an operative connection is created, which allows for transforming the adjusting movement into a fine-tuning movement. Said operative connection may be configured to be differently complex. While in the following mainly solutions are described, which are based on a reduced complexity, basically a form of a conversion gear may be provided as the operative connection, in order to provide a corresponding transformation of the adjusting movement into a fine-tuning movement between the first adjusting means and the second adjusting means. Said transformation is in particular aimed at the type of movement, namely rotation, translation, linear motion or the like, as well as to the direction of movement.

According to the disclosure, it is now possible to attach the entire roller carriage by means of its basic body to the sliding door. Subsequently, the roller module with the bearing devices attached thereto is inserted into a roller running path, such that the sliding door, via the roller module and thereby the entire roller carriage, props up on the roller running path and is disposed in a suspended position. Already, in this position, the gap is formed at the underside of the sliding door to the floor and can be measured. For modifying said gap width, the adjusting movement is now performed at the first adjusting means. Based on the operative connection with the second adjusting means, by performing the adjusting movement and the associated performing of the fine-tuning movement, the relative positioning between the basic body and the roller module changes. Depending on the direction of the adjusting movement, and resulting therefrom depending on the direction of the fine-tuning movement, the sliding door together with the basic body will lift or lower in relation to the roller module. As a result, the gap on the underside between the floor and the lower edge of the sliding door will change. In this case, it can be very well seen how simple, inexpensive and moreover quick the mounting with regard to the adjustment of the height fine-tuning can be provided.

The operative connection between the two adjusting means is provided to be preferably continuous. This means, both prior to performing the adjusting movement and after completing the adjusting movement, said operative connection remains effective, which is in particular configured as a direct contact between the two structural components. In this case, a direction of gravity is understood to be the respective reference to the installation situation. As in particular a suspended disposition is concerned when inserting the roller module into the roller running path, the direction of gravity is in particular oriented vertically or essentially vertically to the corresponding bearing axes of associated rollers or other associated bearing means.

It may be an advantage, if, in an inventive roller carriage, the first adjusting means is supported at the basic body to be rotatable, at least for part of the adjusting movement, in particular by means of an adjusting thread. A rotary motion allows for providing a particularly defined adjustment for the fine-tuning movement. In this case, in particular defined threads, namely standardized threads or even fine threads are employed. Moreover, via a rotating configuration by means of an adjusting thread, a combination with a linear translatory motion is realized. A rotation, which as a movement is introduced into a corresponding manipulation interface of the first adjusting means, is transformed into the translatory part of the adjusting movement. Said translatory, respectively linear motion, which is essentially triggered by the rotary component, is transformed into a corresponding fine-tuning movement by means of the operative connection at the second adjusting means. This procedure may be realized by means of contacting surfaces. It is for example conceivable that the second adjusting means is configured as an inclined plane, such that screwing the first adjusting means into a corresponding adjusting thread and the associated linear translatory displacement will result in the first adjusting means sliding on the inclined plane of the second adjusting means. This in turn, due to the corresponding displacement, results in a lifting or lowering of the basic body in relation to the roller module. In this case, the degree of lifting and the created forces depend on the thread pitches as well as on the slope of the inclined plane. In this case, the individual structural components, in particular the first adjusting means, have the corresponding mechanical parameters. A threaded bolt may be employed here for example, which represents the first adjusting means. As a steel alloy, the latter may have an E-modulus in the range of approximately 210 $kN/mm^2$, in particular ±20 $kN/mm^2$. In the event an adjusting thread is employed, there are in particular at least eight thread revolutions in engagement. Preferably, such a threaded bolt has at least approximately 15 thread revolutions so as to provide for corresponding room for adjustment. Preferably, a torque of less than approximately 5 Nm, in particular ±2 Nm is sufficient to perform the movement of a rotation. Simplifying the adjusting movement to a rotary motion, in particular in case of an adjusting thread entails thereby a further reduction of the complexity and a further reduction of the mounting time.

According to the disclosure, it is likewise an advantage, if, in an inventive roller carriage, the first adjusting means is supported at the basic body to be displaceable, at least for part of the adjusting movement, in particular by means of an adjusting thread. Already, at this stage, the reference to an adjusting thread clearly illustrates the correlation of combined types of motion for the adjusting movement. However, basically a pure displacement, in particular a linear displacement, is basically conceivable. The advantage of the combination with an adjusting thread is in particular found in the self-retaining configuration of such an adjusting thread. The correlation between rotary motion in the thread and translatory motion of the adjusting means by the thread results in that the movement, similar to a worm drive, can be exclusively produced by rotating the adjusting means. The counter-pressure of the weight of the sliding door, which acts in a pushing way in translatory direction onto the adjusting means, props up against the thread revolutions and does not at all result in the adjusting means rotating back. This translates into increased safety during the mounting procedure. The adjusting movement with regard to its linearly translatory movable orientation, respectively component, is disposed in particular perpendicularly to the direction of gravity. This circumstance translates into a simplified access and most of all into a simplified execution of the adjusting movement.

It is likewise advantageous, if, in an inventive roller carriage, the first adjusting means includes a contacting portion and the second adjusting means includes a counter-contacting portion, wherein the contacting portion contacts the counter-contacting portion for forming the operative connection between the first adjusting means and the second adjusting means. Said contacting portions in particular of surfaces, which touch each other at least in point-form. However, basically likewise a line-shaped full contact is conceivable between said two portions. In this case, the surface contours of contacting portion and counter-contacting portion are basically free. However, for a reduced complexity at least one of said two portions is configured as a flat surface, in particular as an inclined plane. Direct contacting between said two portions and thereby between the two adjusting means represents a particularly simple and inexpensive embodiment of the required operative connection according to the disclosure. Contacting portion and counter-contacting portion thus move in relation to each other in a contacting manner, such that preferably a gliding on each other occurs. In order to prevent, respectively to minimize friction in these portions, the surfaces are preferably configured to have minimum friction. This can be achieved by means of reduced surface roughness. However, also additional coatings in firm or partially liquid form may produce the corresponding friction reduction.

Another advantage may be found, if, in an inventive roller carriage, the contacting portion and the counter-contacting portion are configured for a transformation of a direction of the adjusting movement of the first adjusting means transversely to the direction of gravity in a direction of the fine-tuning movement of the basic body along the direction of gravity. Thus, the contacting portion and the counter-contacting portion act as a type of conversion gear about 90° or essentially 90° . Usually, the direction of gravity is directed vertically to the floor in the installation situation. In this embodiment, this results in that the adjusting movement is performed in the direction transversely to said direction of gravity, namely horizontally. As the adjusting means often includes a manipulation interface, by means of which the adjusting movement can be performed with a manipulation tool, said correlation results in the orientation of the adjusting movement, and the fine-tuning movement in that said adjusting movement can be performed in a simpler way and most of all with easier access. In particular large and easy operable manipulation tools can be employed in this way.

The inventive roller carriage may be further developed in that the counter-contacting portion and/or the contacting portion are configured at least partially as an inclined plane. In this case, it is question of a preferred and in particular very inexpensive embodiment of the operative connection between the two adjusting means. In this case, in particular the orientation, respectively the conversion of the adjusting movement and the fine-tuning movement is possible by means of the already described sliding. As the tilt angle for the inclined plane, a range between approximately 30° and approximately 50° is preferred. In particular the tilt angle of the inclined plane is in the range of approximately 45° . With the intention to provide sufficient strength, the contacting portion and/or the counter-contacting portion are provided with a hardness of more than approximately 160 HV (Vickers hardness), in particular ±12 HV. In particular they have an E-modulus in the range of approximately 210 kN/mm$^2$. In order to limit the friction during gliding on each other, preferably a surface roughness of Rz ≤ approximately 32 μm, in particular in the range between 20 μm and 30 μm is provided. In this case, the counter-contacting portion is integrally configured with the roller module. This is in particular in an embodiment as a casting part of advantage with regard to cost reduction during manufacturing. The counter-contacting portion and/or the contacting portion may include a vertical walling at the end of the inclined plane, in order to form a corresponding abutment for a final terminal contact. This arrangement results in preventing any further relative displacement and thereby in providing a first end, in the shape of a mechanical abutment for the adjusting movement. It is a translation abutment protection having the purpose of delimiting the possible movement for the fine-tuning movement, respectively the adjusting movement in at least one direction.

Another advantage may be, if, in an inventive roller carriage, the contacting portion and/or the counter-contacting portion present(s) at least partially a curved surface. In this case, in particular an essentially flat surface correlates with a curved surface, in particular of a spherical segment. The contacting portion of the first adjusting means may present for example a corresponding curved surface, which therefore presents a reduced contact surface with the counter-contacting portion. Moreover, the weight of the respective contacting portion, respectively of the first and/or second adjusting means are/is thereby reduced. The diameter of such a half-sphere for the contacting portion may be for example in the range between 4 mm and 6 mm for a metric thread of M6 with a thread pitch of 1 mm. In the event a thread M8 with a 1.23 mm thread pitch is selected, the sphere diameter is preferably in the range between 5 mm and 8 mm. In this case again preferably mechanical parameters in the range of an E-modulus of approximately 210 kN/mm$^2$, in particular ±20 kN/mm$^2$ are employed for the first adjusting means. A higher hardness of > approximately 450 HV (Vickers hardness), in particular of less than 800 HV is likewise preferred. Roughness grades of said contacting portion in the sphere range are in particular about 25 μm (Rz), in particular in the range of 20 μm and 30 μm. In this case, the contacting portion is configured with a form closure, a connection via material, a non-positive connection, respectively integrally with the rest of the adjusting means.

It is furthermore advantageous, if an inventive roller carriage is configured such that the counter-contacting portion and/or the contacting portion include(s) at least one reinforcing rib for a mechanical reinforcement in the direction of gravity. Such a rib or a plurality of two or more ribs serve to reduce the cross-section, respectively the wall thickness of the second adjusting means. Said arrangement results in a lighter and most of all improved and mechanically more stable embodiment, in particular in a steel diecasting process. The mechanical reinforcement may include in this case upright ribs or ribs exactly along the direction of gravity.

Another advantage is, if, in an inventive roller carriage, at least one securing device is provided for a securing affixing of the displaceable bearing of the basic body at the roller module. Such a securing device may be realized for example by means of one, two or more screws, which extend through holes in the roller module and in the basic body. They serve to affix the roller module and the basic body to each other in a fine-tuned position, and thereby to relieve the height adjusting device, namely the two adjusting means. In this case, an additional path of force is provided via the securing device, which now allows for the forces, occurring during operation, not only be transferred via the operative connection between the two adjusting means. In addition to the reduction of the necessary mechanical requirements on the two adjusting means, this arrangement results in that the height adjusting device remains available to be employed later, because mechanical damaging by means of the securing device is essentially excluded. In this case, the securing device may deploy its corresponding securing action as a form closure, as a friction connection and/or as a non-positive connection.

Furthermore, it may be an advantage, if, in an inventive roller carriage, the first adjusting means includes a manipulation interface for the engagement of an adjusting force for performing the adjusting movement. In this case, the manipulation interface is disposed on a first side of the roller carriage and a bearing device of the roller module for the displaceable affixing at the roller running path is disposed on a second side of the roller carriage, which is located opposite to the first side. In other words, the bearing device and the access to the manipulation interface are located on opposite sides of the roller carriage. As the roller running path is usually attached directly to the wall above the door opening, based on said opposing disposition, the manipulation interface points now away from the wall above the door opening. A possibility for adjustment at the front is thereby given, which results in an easier access. In the installed condition of the roller carriage, this arrangement allows for easier access and thereby quick performing of the fine-tuning movement and thereby of the preceding adjusting movement.

According to the disclosure, it is furthermore an advantage, if, in the roller carriage, an abutment device is provided for delimiting the fine-tuning movement along the direction of gravity to the top and/or to the bottom. In this case, it may be the above-described walling, which may be a component of one of the two adjusting means. Also oblong holes may be provided, which with corresponding pins, represent a limitation to the top and to the bottom. In particular a collection abutment to the bottom is provided, so, in the event of a potential failure of the adjusting means, the entire basic body together with the sliding door is prevented from sliding out of its bearing at the roller module. This arrangement reduces the mounting risk. For example oblong holes can be employed, which with corresponding securing screws simultaneously build the securing device as already explained.

A sliding door installation, including a roller running path and at least one inventive roller carriage, which is supported in the roller running path to be displaceable according to the present disclosure, is likewise a subject matter of the present disclosure. Preferably, at least two roller carriages according to the present disclosure are provided, which accommodate and retain a sliding door. By employing inventive roller carriages, an inventive sliding door installation offers the same advantages as those explained in detail in relation to an inventive roller carriage.

Another subject matter of the present disclosure is a method for fine-tuning the height of a sliding door of a sliding door installation having the features of the present disclosure. Such a method includes the following steps:

attaching a sliding door to a basic body of a roller carriage according to the present disclosure, inserting the roller carriage into a roller running path a displaceable supporting, performing an adjusting movement of the first adjusting means for producing a fine-tuning movement of the basic body along a direction of gravity for setting a defined gap measure between the lower edge of the sliding door and a floor underneath.

Obviously, the last two steps of the inventive method may be performed in the reverse order, even though the described order is preferred. By employing an inventive sliding door installation as well as an inventive roller carriage, an inventive method offers the same advantages as those explained already in detail in relation to an inventive roller carriage.

BRIEF DESCRIPTION OF THE DRAWINGS

Further advantages, features and details of the disclosure will result from the following description, in which exemplary embodiments of the disclosure are described in detail, reference being made to the drawings. In the drawings.

DETAILED DESCRIPTION OF THE DRAWINGS

Figure 1:
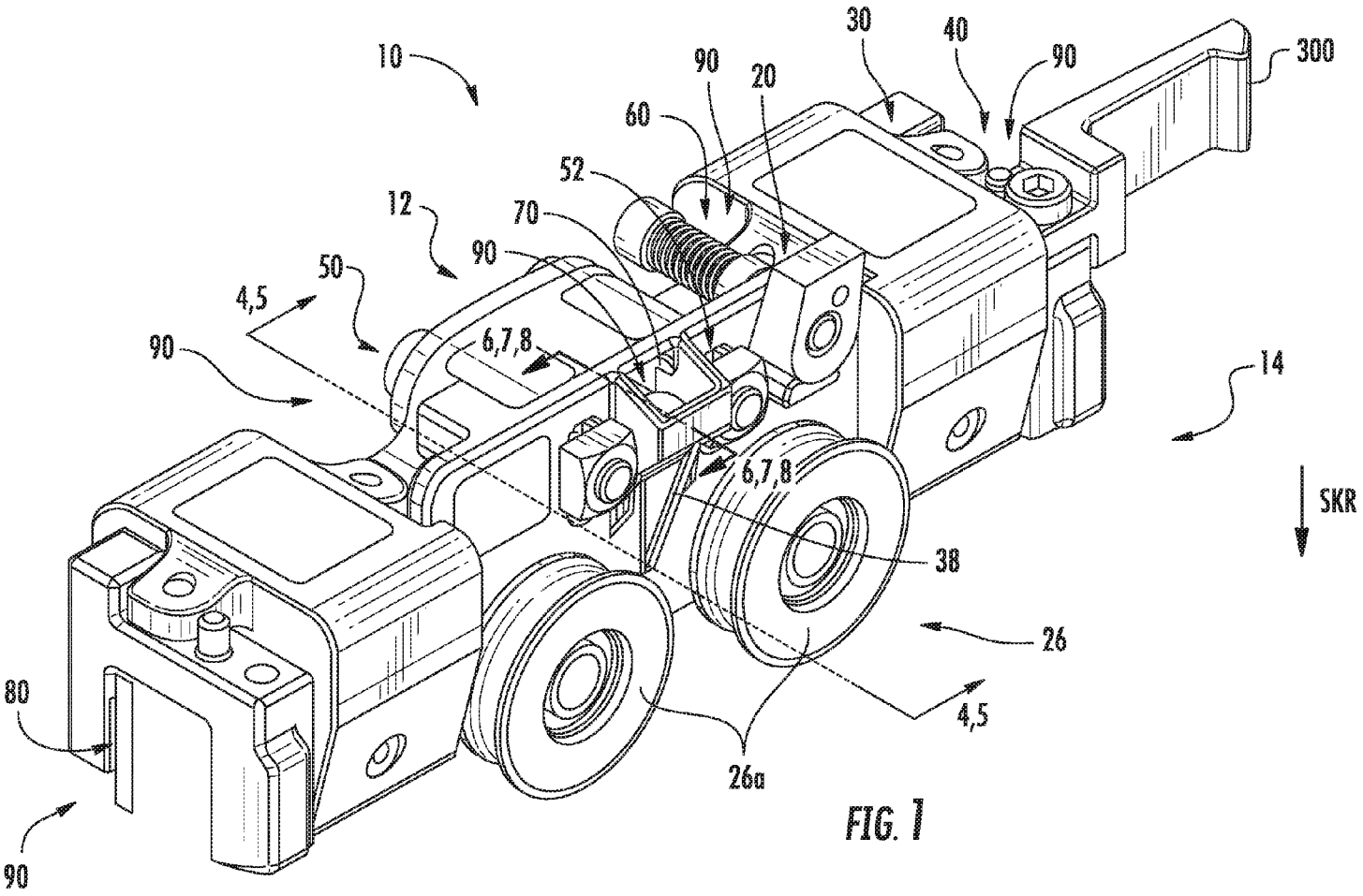
FIG. 1 an embodiment of a roller carriage.

An embodiment of a roller carriage 10 is illustrated in an isometric illustration in FIG. 1. Basically, said carriage includes two structural components. In this case, the components are on the one hand, the roller module 20 and, on the other hand, the basic body 30. In this case, both structural components, namely the roller module 20 and the basic body 30 include a plurality of individual parts. Said individual parts will be briefly explained in the following.

Figure 3:
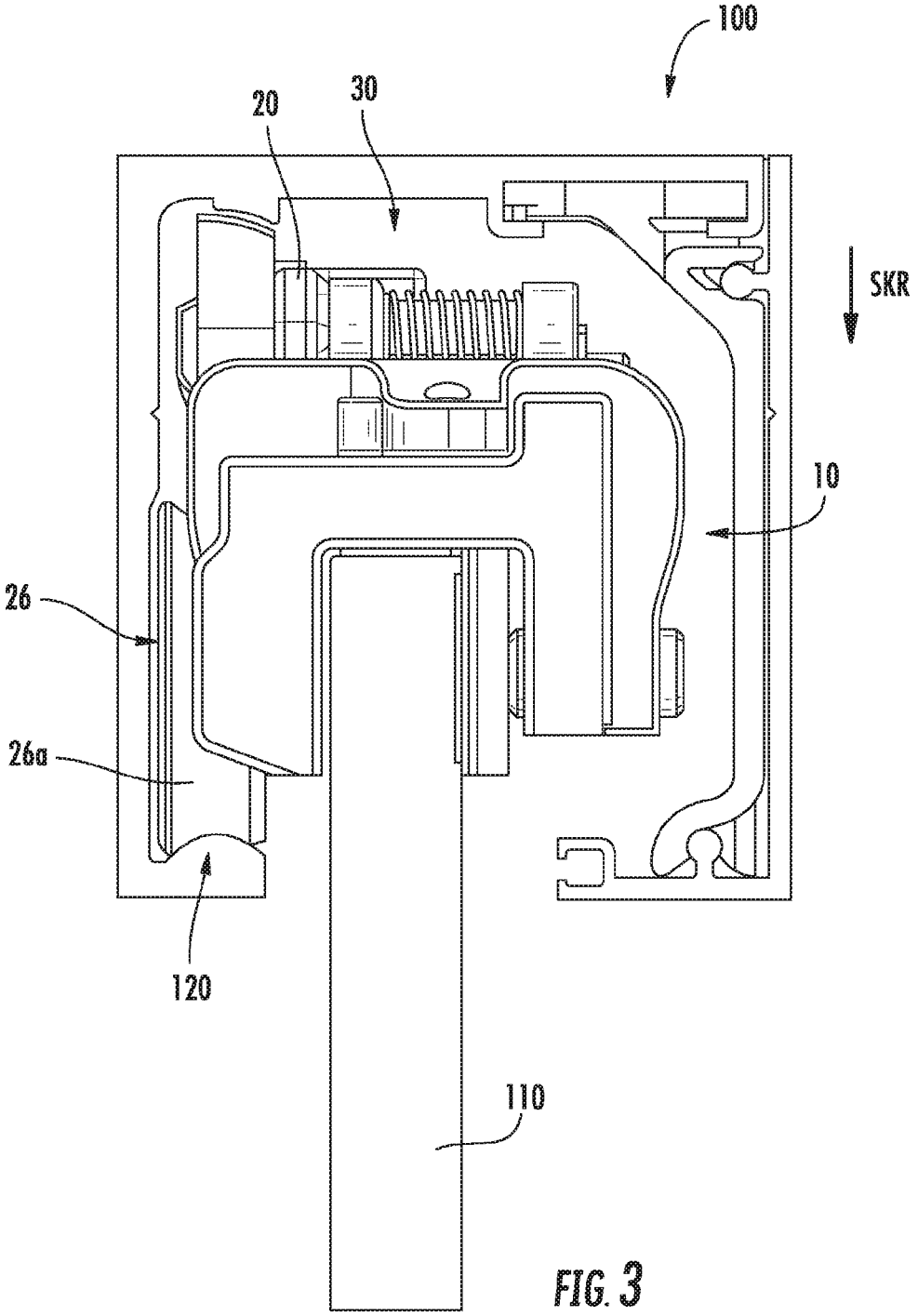
FIG. 3 a lateral illustration of a roller carriage in a roller running path, FIG. 4 a lateral illustration of a roller carriage in cross-section, FIG. 5 the illustration of FIG. 4 in an isometric sectional view, FIG. 6 a first embodiment of a height adjusting device, FIG. 7 a second embodiment of a height adjusting device, and FIG. 8 a third embodiment of a height adjusting device.
Figure 5:
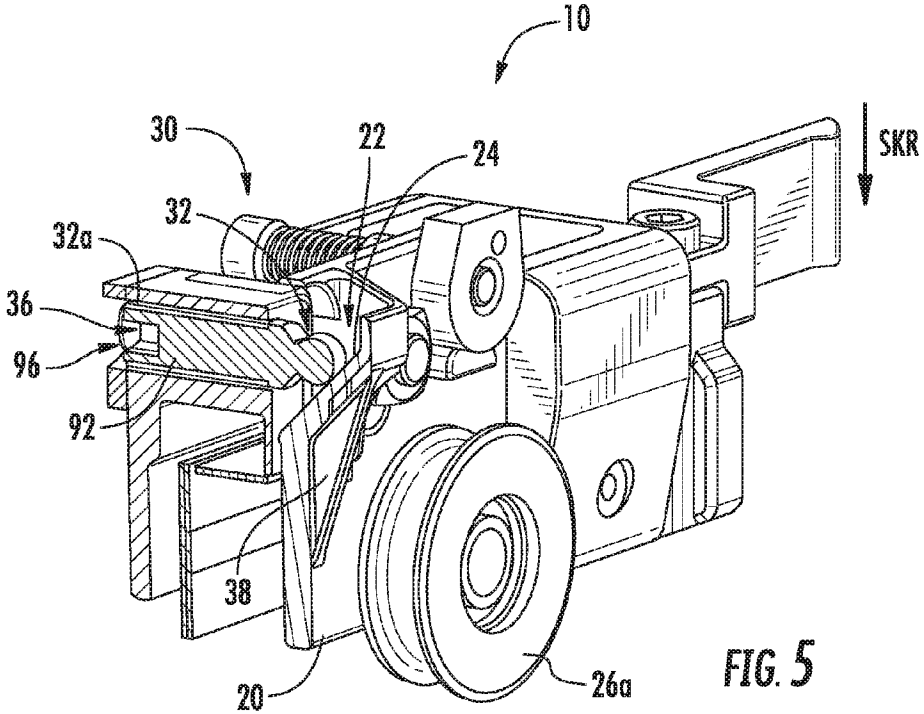
Figure 4:
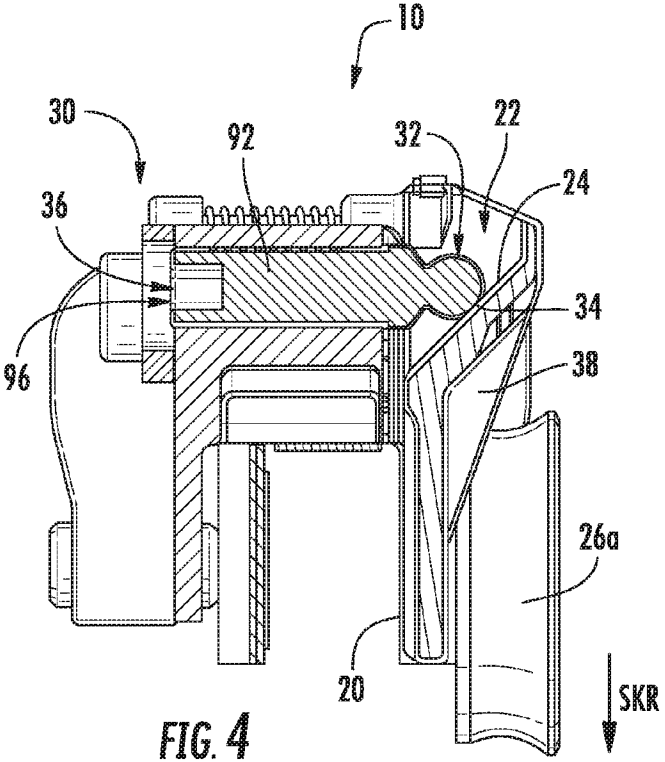

Here, the roller module 20 is equipped with a bearing device 26. Said bearing device 26 is equipped in this case with two rollers 26*a*, which are supported to be rotatable at a basic body of the roller module 20. Said rollers 26*a* can be placed onto, respectively inserted into a roller running path 120, as can be clearly seen in FIG. 2 and FIG. 3. A part of a height adjustment device 70 is provided furthermore at the roller module 20. The detailed components of said height adjustment device 70 are in particular illustrated in the FIGS. 4 and 5. Thus, a first adjusting means 32 is provided, which by means of a manipulation interface 36 is able to perform an adjusting movement. As, in this case, the first adjusting means 32 is configured as a threaded bolt in an adjusting thread 32*a*, a rotary motion is performed at the manipulation interface 36, which motion simultaneously produces a linear translatory motion of the first adjusting means 32. Via a corresponding contacting portion 34, the first adjusting means 32 is in operative connection with a counter-contacting portion 24 of the second adjusting means 22. In this case, the explicit action of said adjusting device relates to transforming the adjusting movement into a fine-tuning movement along the direction of gravity SKR.

As can be seen in FIG. 1, the roller carriage 10 is equipped with a plurality of different mounting devices 90, which are able to provide different mounting functions. In this case, the already described fine-tuning function of the height of the sliding door 110 is provided by means of the mounting device 90 in the shape of the height adjusting device 70. Furthermore, a mounting device 90 in the shape of a securing device 50 is provided, which, after completed fine-tuning of the height of the sliding door 110, provides a clamping fixing between the basic body 30 and the roller module 20.

In this case, a further mounting device 90 is disposed in an accessory device 40, which is provided by means of a corresponding interface and an affixed accessory module 300. Moreover, a lift-off protection device 60 is provided as a mounting device 90, which provides a lift-off protection against unwanted removal of the roller carriage 10 out of the position in which it is inserted into the roller running path 120. Furthermore, an attachment device 80 is provided as a glass clamp for a mounting device 90, in order to affix the sliding door 110 in a clamping manner.

All mounting devices have in common that they include at least one mounting means 92, in order to be able to perform a corresponding mounting movement. Moreover, a manipulation interface is provided, intended to allow for performing exactly said mounting movement with the mounting means.

As moreover revealed in FIG. 1, the roller carriage 10 has different sides, namely the first side 12 and the second side 14. In this case with regard to their manipulation interface 96, all mounting devices are preferably aligned from the same side, namely the first side 12 opposite to the second side 14, on which the bearing device 26 is disposed. This arrangement offers a considerably simpler access.

Figure 2:
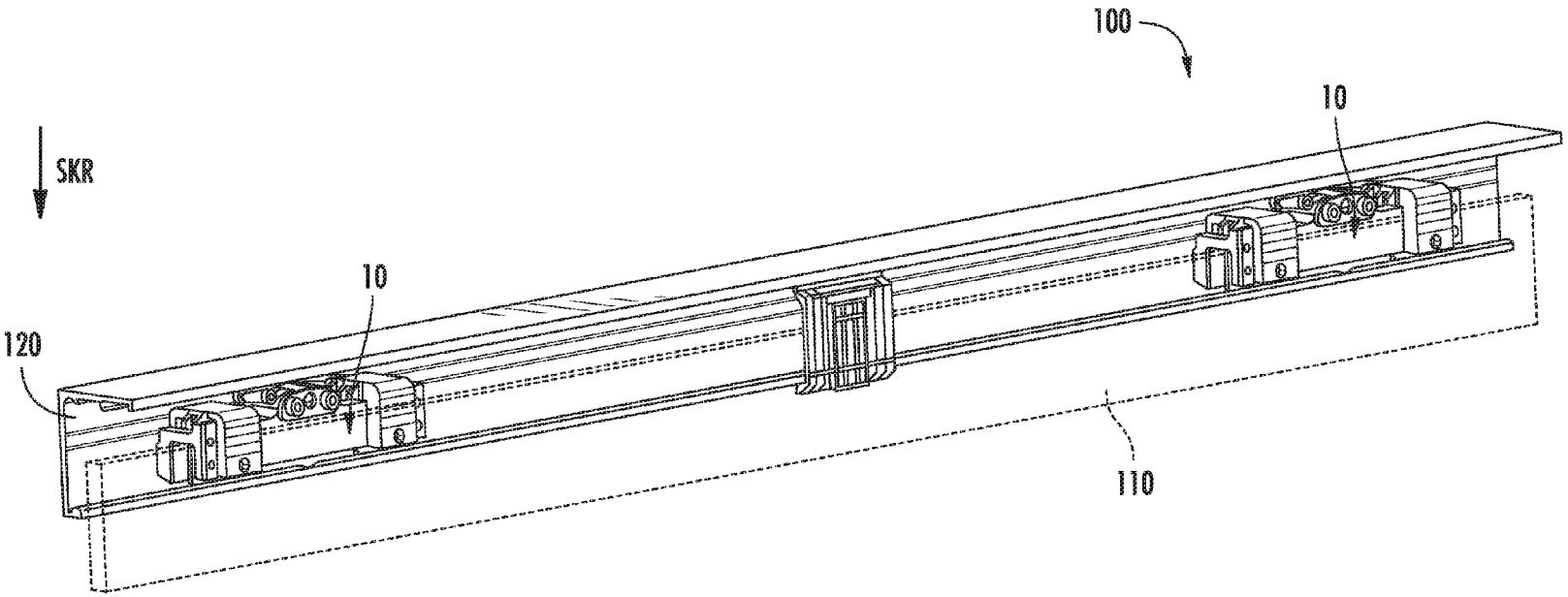
FIG. 2 an embodiment of a sliding door installation.

FIG. 2 reveals how a sliding door 110 is retained by means of two roller carriages 10 according to FIG. 1, and that the two roller carriages 10 are already inserted into the roller running path 120. In a lateral illustration according to FIG. 3, in particular the correlation of the rollers 26*a* with the roller running path 120 is well visible.

Figure 6:
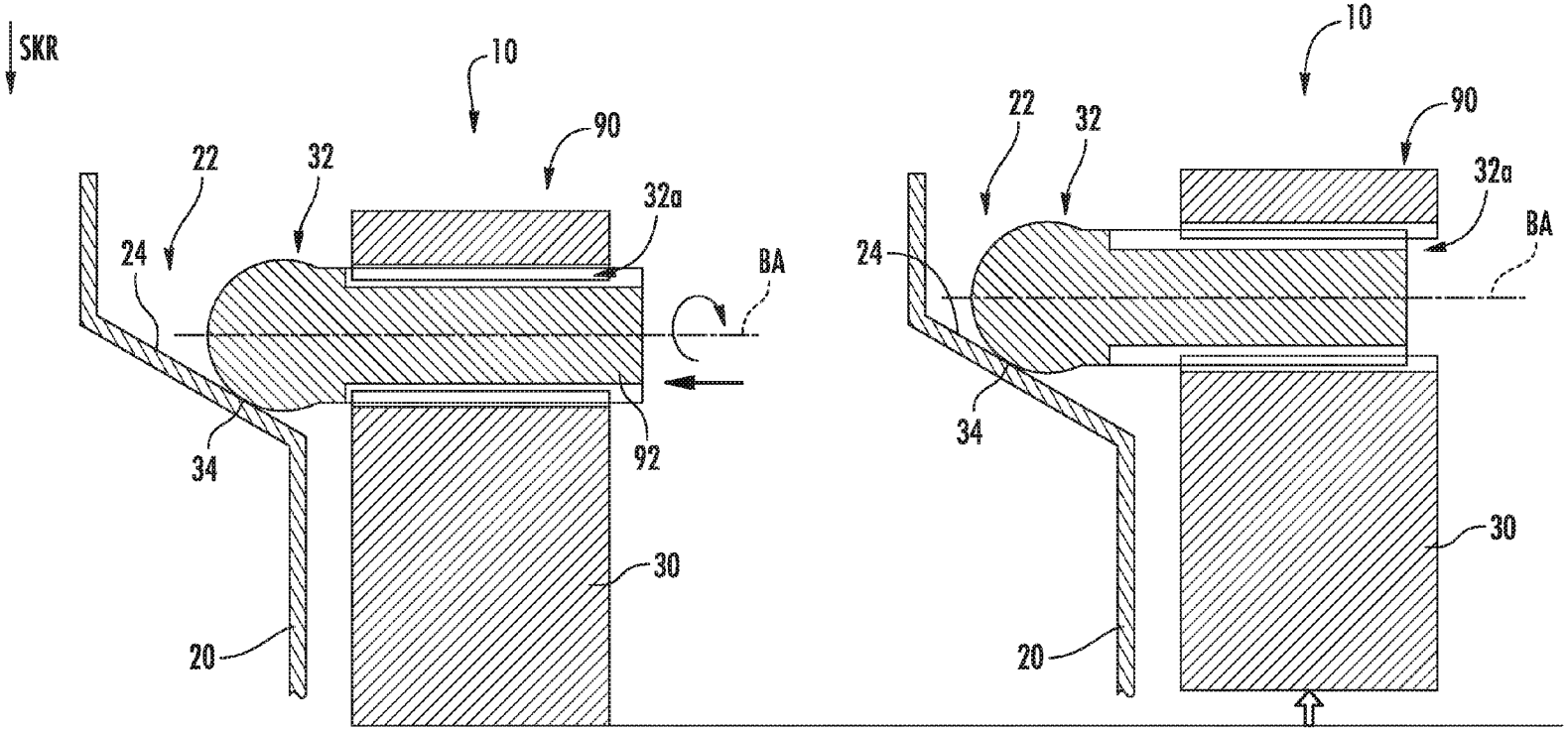
Figure 7:
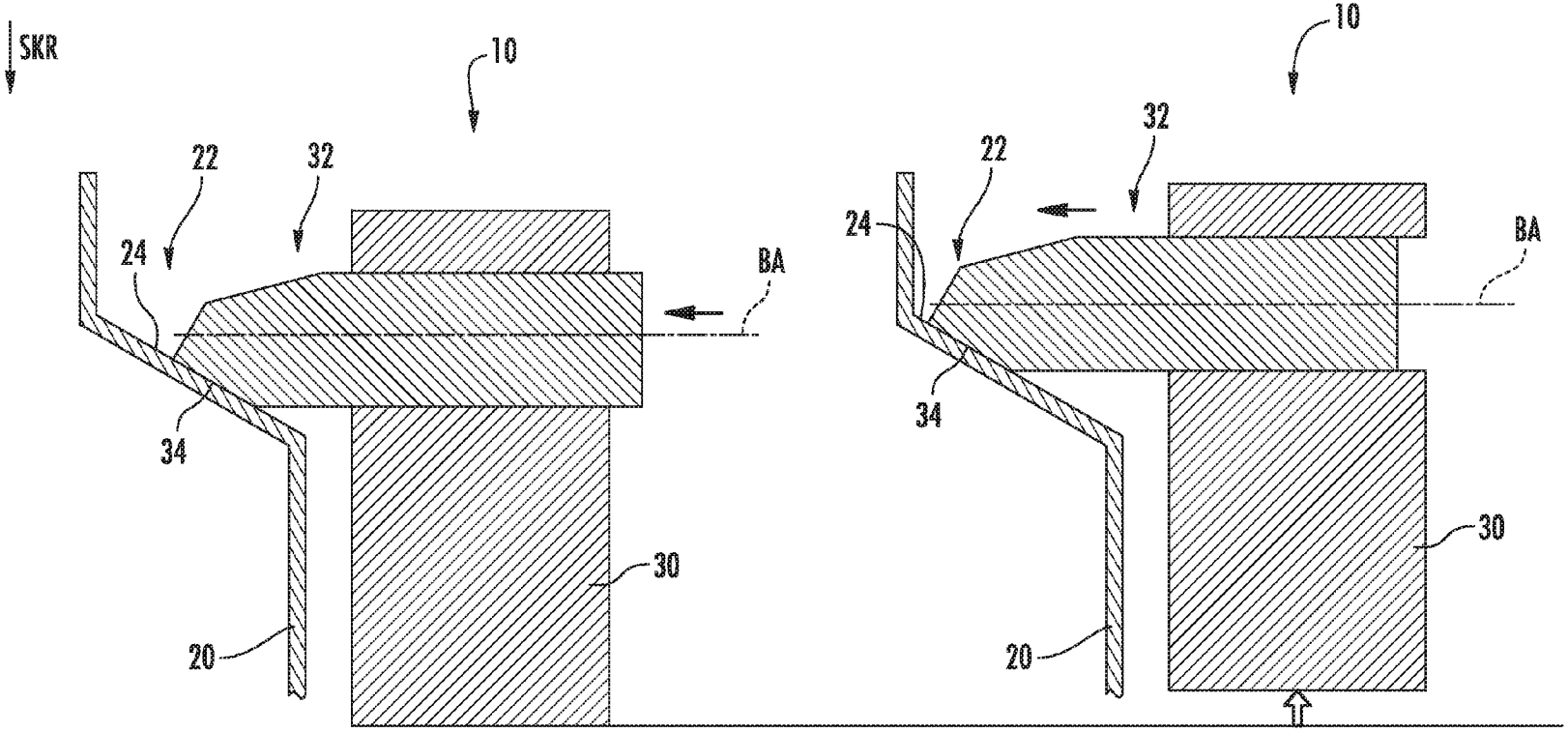
Figure 8:
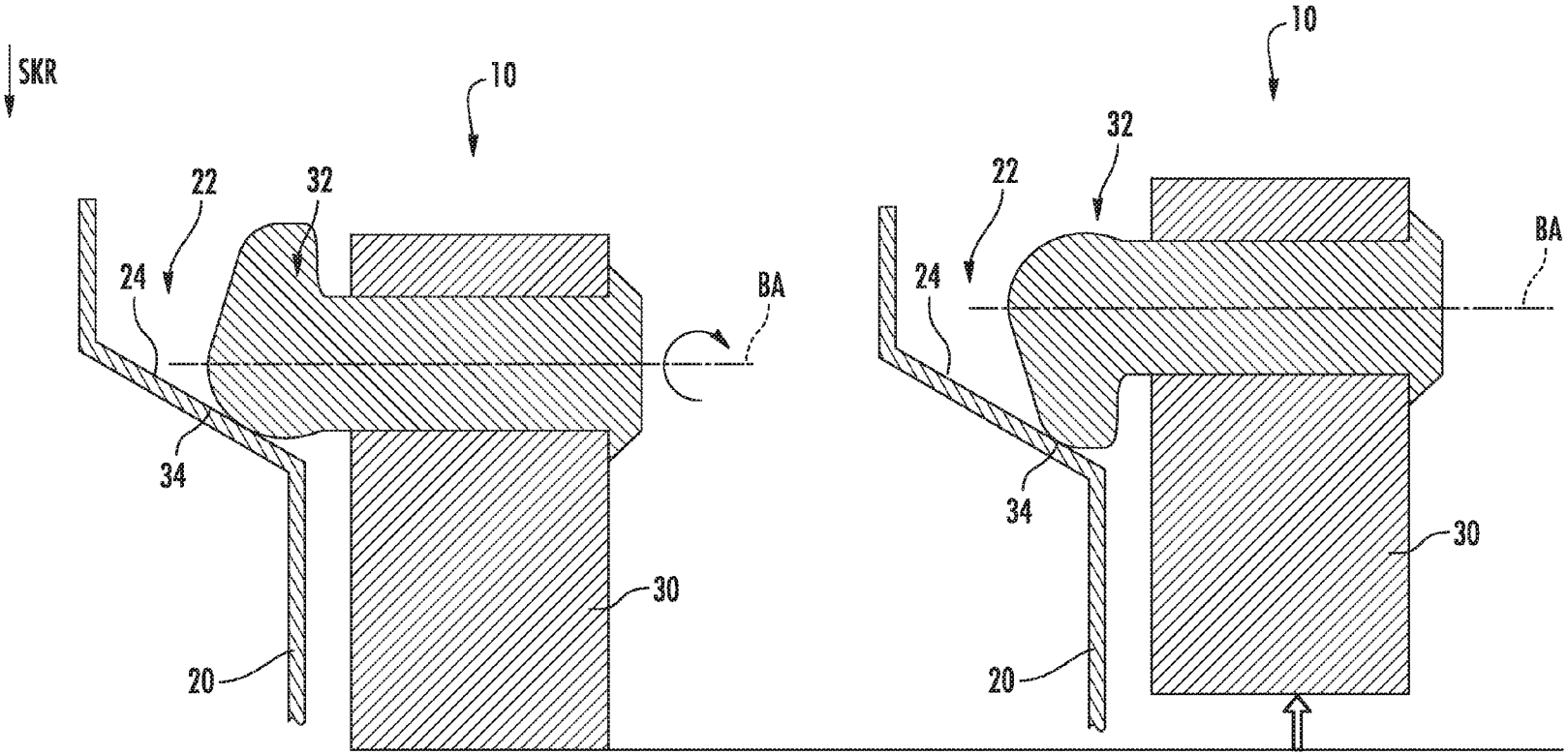

FIGS. 6-8 illustrate details with regard to different embodiments of the height adjusting device 40. Said FIG. 6 shows a solution, in which the first adjusting means 32 performs a combination of rotary motion and linear motion. The first adjusting means 32, configured as a threaded bolt, is rotated in an adjusting thread 32*a* about an axis of movement BA and moves in this way in FIG. 6 from the right side to the left side. A contacting portion 34*a* slides thereby on a counter-contacting portion 24 and lifts the entire basic body 30 in relation to the roller module 20. And as the sliding door 110 is attached to the basic body 30, the sliding door 110 is thereby lifted as well. Instead of a spherically shaped head another embodiment, in particular conical or truncated is conceivable.

FIG. 7 illustrates a solution, which exclusively provides a displacement, in particular in a linear way, as the adjusting movement. In this case, a linear guide is provided at the basic body 30, along which the first adjusting means 32 is pushed. The full contact between the contacting portion 34 and the counter-contacting portion 24 results in mutual sliding on each other and thereby likewise in a lifting of the basic body 30.

FIG. 8 illustrates a purely rotary solution of the first adjusting means 32, which by means of an eccentric head and rotary sliding of the contacting portion 34 on the counter-contacting portion 24 likewise provides the lifting of the basic body 30 in relation to the roller module 20, as already described several times.

The above explanation of the embodiments describes the present disclosure exclusively based on examples. Obviously, individual features of the embodiments, as long as technically reasonable, can be combined independently of each other without leaving the scope of the present disclosure.

The invention claimed is:

1. A roller carriage that receives a sliding door, the roller carriage comprising a roller module that displaceably affixes the roller carriage at a roller running path, and a basic body attached to the sliding door, wherein the roller module includes a bearing device with at least two rollers disposed on a first side of the roller carriage, the at least two rollers supported to be rotatable at the basic body and inserted into the roller running path and on a plane parallel to the sliding door, wherein the basic body is supported at the roller module and is displaced along a vertical direction for a fine-tuning movement of the basic body, wherein a first adjusting means is disposed at the basic body and is supported at the basic body to rotate with an adjusting thread, and when performing the adjusting movement, the first adjusting means is in operative connection with a second adjusting means of the roller module.

2. The roller carriage according to claim 1, wherein the first adjusting means is configured to be displaced.

3. The roller carriage according to claim 1, wherein the first adjusting means includes a contacting portion, and the second adjusting means includes a counter-contacting portion, wherein the contacting portion contacts the counter-contacting portion and forms an operative connection between the first adjusting means and the second adjusting means.

4. The roller carriage according to claim 3, wherein the contacting portion and the counter-contacting portion are configured to transform a direction of the adjusting movement of the first adjusting means transversely to the vertical direction in a direction of the fine-tuning movement of the basic body along the vertical direction.

5. The roller carriage according to claim 3, wherein the counter-contacting portion or the contacting portion are configured at least partially as an inclined plane.

6. The roller carriage according to claim 3, wherein the contacting portion or the counter-contacting portion include(s) an at least partially arched surface.

7. The roller carriage according to claim 3, wherein the counter-contacting portion or the contacting portion include(s) at least one reinforcing rib that mechanically reinforces in the vertical direction.

8. The roller carriage according to claim 1, wherein at least one securing device securely fixes a displaceable bearing of the basic body at the roller module.

9. The roller carriage according to claim 1, wherein the first adjusting means includes a manipulation interface that engages an adjusting force for performing the adjusting movement, wherein the manipulation interface is disposed on a first side of the roller carriage, and a bearing device of the roller module is displaceably affixed at the roller running path and disposed on a second side of the roller carriage, the second side being disposed opposite the first side.

10. The roller carriage according to claim 1, wherein an abutment device delimits the fine-tuning movement along the vertical direction to a top or to a bottom.

11. A sliding door installation, including a roller running path and at least one roller carriage supported to be displaceable in the roller running path having a basic body that attaches to the sliding door, wherein the basic body is supported at a roller module and displaced along a vertical direction for a fine-tuning movement of the basic body, wherein the roller module includes a bearing device with at least two rollers disposed on a first side of the roller carriage, the at least two rollers supported to be rotatable at the basic body and inserted into the roller running path and on a plane parallel to the sliding door, wherein a first adjusting means is disposed at the basic body to rotate with an adjusting thread, and when performing the adjusting movement, the first adjusting means is in operative connection with a second adjusting means of the roller module.

12. The sliding door installation according to claim 11, wherein at least one sliding door is supported to be displaceable in the roller running path by means of at least two roller carriages.

13. A method for fine-tuning a height of a sliding door of a sliding door installation having a roller running path and at least one roller carriage supported to be displaceable in the roller running path having a basic body that attaches to the sliding door, wherein the basic body is supported at a roller module to be displaceable along a vertical direction for a fine-tuning movement, wherein the roller module includes a bearing device with at least two rollers disposed on a first side of the roller carriage, the at least two rollers supported to be rotatable at the basic body and inserted into the roller running path and on a plane parallel to the sliding door, wherein a first adjusting means for an adjusting movement is supported to be movable at the basic body, wherein, for a movement of the basic body along the vertical direction in relation to the roller module, when performing the adjusting movement, the first adjusting means is in operative connection with a second adjusting means of the roller module, including the following steps:

attaching a sliding door to a basic body of a roller carriage, inserting the roller carriage into a roller running path for a displaceable bearing, performing an adjusting movement of the first adjusting means for producing a fine-tuning movement of the basic body along the vertical direction for setting a defined gap measure between a lower edge of the sliding door and a floor underneath.

* * * * *